United States Patent [19]

Chen

[11] Patent Number: 4,930,704

[45] Date of Patent: Jun. 5, 1990

[54] FLOW CONTROLLABLE SPRAY NOZZLE

[76] Inventor: Teng C. Chen, No. 9, Lane 114, Ta Hsing St., Tainan City, Taiwan

[21] Appl. No.: 227,088

[22] Filed: Aug. 1, 1988

[51] Int. Cl.[5] ..... B05B 1/30

[52] U.S. Cl. ..... 239/579; 239/581.2; 251/251; 251/351

[58] Field of Search ..... 251/251–253, 251/262, 263, 351; 137/901; 239/456–459, 581.1, 581.2, 582.1, 579

[56] References Cited

U.S. PATENT DOCUMENTS

| | | | |
|---|---|---|---|
| 376,129 | 1/1888 | Anderson | 137/901 X |
| 715,622 | 12/1902 | Stretch | 251/252 X |
| 1,488,008 | 3/1924 | Jones | 137/901 X |
| 1,590,818 | 6/1926 | Gehbauer | 251/252 X |
| 1,987,135 | 1/1935 | Sugden | 251/252 X |
| 2,005,128 | 6/1935 | Bowes | 251/251 |
| 3,784,113 | 1/1974 | Specht | 251/251 X |
| 4,129,257 | 12/1978 | Eggert | 239/582 X |

FOREIGN PATENT DOCUMENTS

| | | | |
|---|---|---|---|
| 46480 | of 1909 | United Kingdom | 239/581.2 |

*Primary Examiner*—Andres Kashnikow
*Assistant Examiner*—Kevin P. Weldon
*Attorney, Agent, or Firm*—Bernard R. Gans

[57] ABSTRACT

A flow controllable spray nozzle comprising a barrel with a pair of symmetrical, helically-inclined slots on the outside surface and a partition plate with a hole formed therethrough disposed inside the barrel, an internally-threaded control ring with an inside diameter greater than the inside diameter of a housing integrated thereunder, depending therefrom, and a plunger secured inside the housing with a threaded nozzle cup screwed on the control ring to define a space therebetween complemental in size and shape to the upper portion of the barrel so as to receive the barrel therein. Each of a pair of symmetrical, threaded holes formed through the housing receives, in order, a cup, a coil spring and a screw with a post projecting therefrom. The cup, being pushed by the reaction force of the spring, is received by and firmly contacts with one of the slots to guide the plunger moving along the slot. A cone is disposed under the plunger. When the plunger is in the lowest position, the cone is in close contact with a gasket disposed around the hole in the partition plate closing the hole. When the plunger is moved upward, the cone loses contact with the gasket and opens the hole, discharging fluid.

9 Claims, 9 Drawing Sheets

FLOW CONTROLLABLE SPRAY NOZZLE

BACKGROUND OF THE INVENTION

The present invention pertains generally to spray nozzles. More particularly, it relates to spray nozzles which may be adjusted to discharge fluid at different flow rates and/or cut off the flow.

Conventionally, in the kitchen or bathroom, the hot water and cold water are controlled by independent faucets. To obtain water with a comfortable temperature and a suitable flow rate, one must adjust both the hot water faucet and the cold water faucet. When one intends to adjust the temperature or flow rate, one must simultaneously adjust both faucets again. Therefore, a spray nozzle with a flow control means will be of great help in handling fluid discharge.

Additionally, for people who garden or wash cars with long hoses, it will be of great convenience to have a handy flow control means mounted on the end of the hoses in order to change the flow rate or to cut off the flow.

Accordingly, in view of the above problems, a flow control means which adjustably discharges fluid with a flow rate from the maximum down to completely closed is of great help and convenience for people who need to change the flow rate.

SUMMARY OF THE INVENTION

In accordance with the foregoing, it is, therefore, a general object of the present invention to provide a flow controllable spray nozzle of which the flow rate can be varied continuously from closed to a maximum rate of flow.

It is a related object of the present invention to provide a flow controllable spray nozzle of which the flow can be interrupted from normal operation.

Other objects and advantages of the present invention will be observed by those having ordinary skill in the art when the following description has been read in conjunction with the accompanying drawings wherein like numerals refer to like or similar parts and in which:

DETAILED DESCRIPTION OF THE PREFERRED EMBODIMENT

Figure 1:
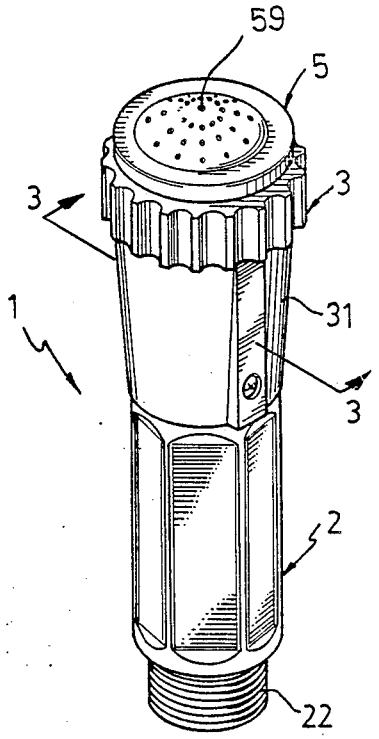
FIG. 1 is a perspective view of one form of spray nozzle in which the feature of the present invention which will be described hereinafter are incorporated.
Figure 2:
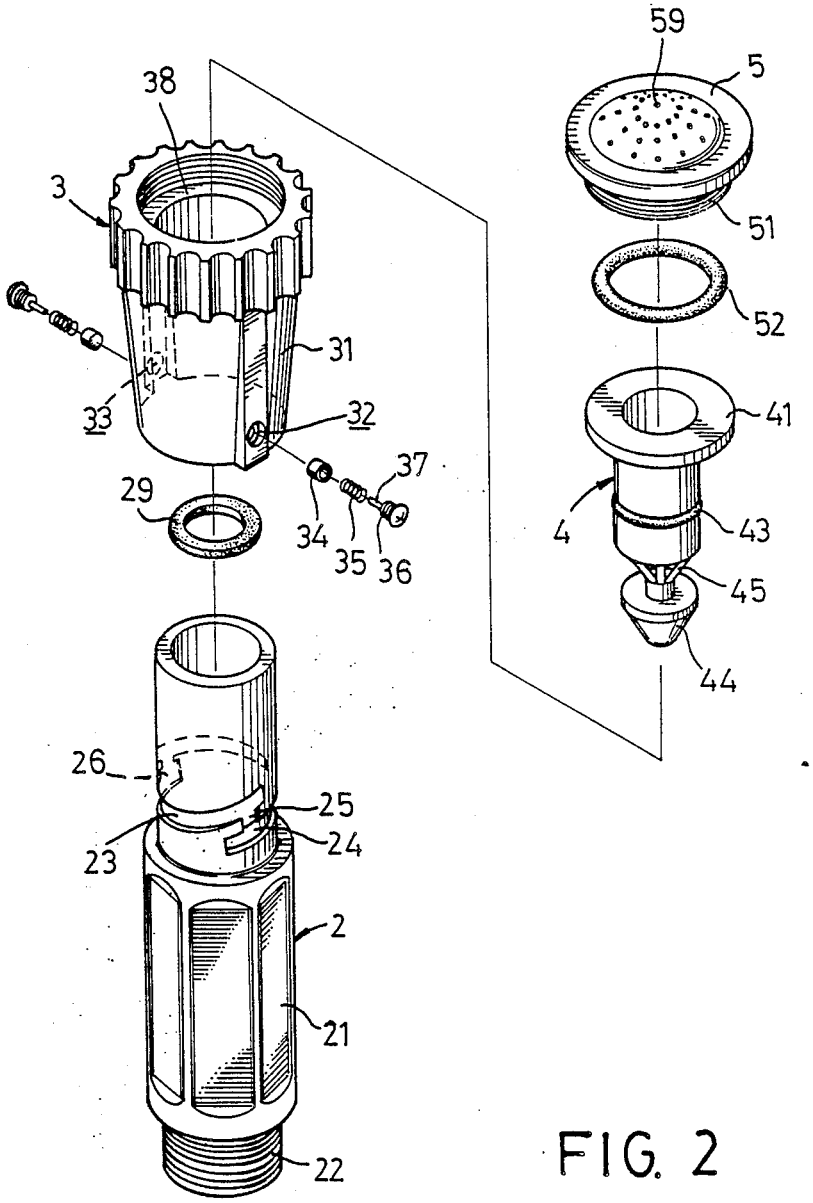
FIG. 2 is a fragmentary view of the spray nozzle shown in FIG. 1.

FIG. 1 depicts a spray nozzle which is broadly designated by reference numeral 1 constructed for connection to and mounting upon the end of a flexible pipe or hose so as to be held in the hand of the user. Details of construction will be explained later, with reference being made to the embodiments illustrated in the drawings wherein like reference numerals indicate like parts.

Figure 4:
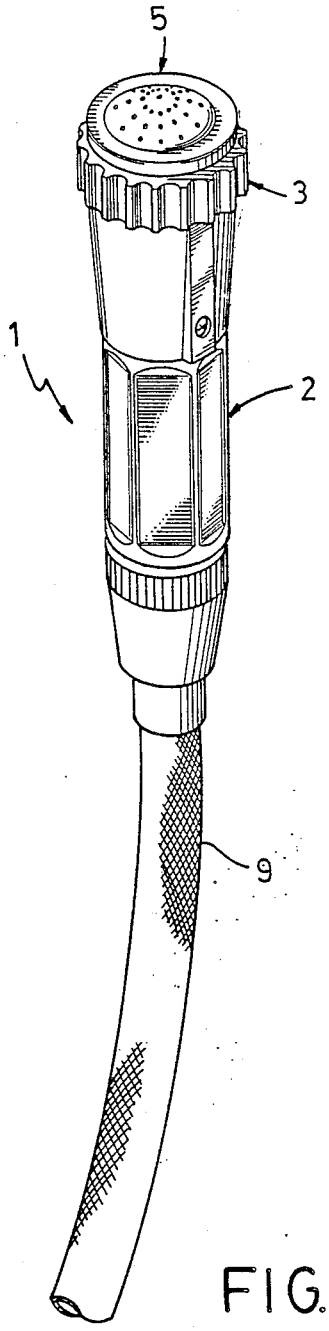
FIG. 4 shows an application of the spray nozzle shown in FIG. 1, with a hose attached thereon.

As illustrated, the spray nozzle 1 includes a barrel 2, a control ring 3, a hollow plunger 4 and a nozzle cup 5. The barrel 2 has a handle section 21 formed on the lower portion thereof with a threaded lower end 22 for attachment to the end of a flexible pipe 9 (FIG. 4). A pair of helically inclined slots 23 and 24 symmetrically disposed around the outside surface of the upper portion of the barrel 2 with the lower end of the first slot 23 slightly overlapped by the upper end of the second slot 24 and vice versa. A pair of substantially vertical slots 25 and 26 are formed on the outside surface of the upper portion of the barrel 2 with the first vertical slot 25 connecting the upper end of the first helical slot 23 and the lower end of the second helical slot 24 and the second vertical slot 25 connecting the upper end of the second helical slot 24 and the lower end of the first helical slot 23. All the slots 23, 24, 25 and 26 have substantially the same width.

Figure 3:
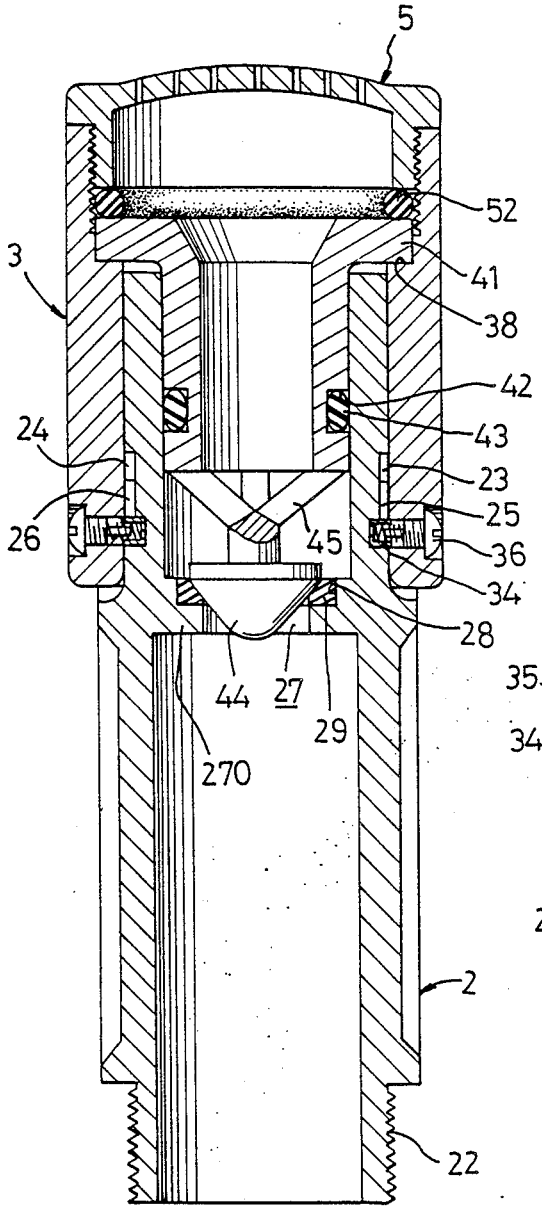
FIG. 3 is a cross-sectional view taken along the line 3—3 in FIG. 1.

As shown in FIG. 3, the interior of the barrel 2 is divided into two sections by a partition 270 with a hole 27 formed therethrough. Around the hole 27, an annular shoulder 28 is formed to receive an annular gasket 29.

The control ring 3 with inner thread has a downward cylindrical housing 31 integrated thereunder to constitute flow control means in part. The housing 31 defines an interior with shape and size thereof complemental to the upper portion of the barrel 2 and the diameter thereof less than the inside diameter of the control ring 3 to define an annular shoulder 38 therebetween. Spacially corresponding to the helical slots 23 and 24 and the vertical slots 25 and 26, a pair of threaded apertures 32 and 33 diametrically symmetrical are formed through the housing 31. Received inside each of the apertures 32 and 33 are, in order, a cup 34, a coil spring 35 and a screw 36 with a forward projecting post 37. The cup 34 with the outside diameter thereof substantially the same as the width of the slots 23, 24, 25 and 26 is disposed in and in close contact with one of the helical slots 23 and 24 or one of the vertical slots 25 and 26. The spring 35 with one end (the outer one) encompassing the post 37 is in contact with the cup 34 with the other end (the inner one), exerts a force therebetween to push cup 34 inward to firmly contact the slot when the screw 36 is screwed into the threaded aperture 32 or 33.

The plunger 4 has a top radial flange 41 disposed therearound to contact and to be received in the shoulder 38 inside the control ring 3. At a proper location of the plunger 4, a circumferential groove 42 is formed therearound with an annular seal 43 received therein. The plunger 4 is in shape and size complemental to the upper interior of the barrel 2 so as to be closely insertable into the barrel 2. The plunger 4 further has a cone 44 depending therefrom with a plurality of small rods 45 connecting therebetween. The cone 44 is so disposed that when the plunger 4 is in the lowest position, the cone 44 contacts and depresses the gasket 29 to cut off the fluid and when the plunger 4 is moved upward, the cone 44 loses contact with the gasket 29, the gap therebetween defining a passage for fluid.

The nozzle cup 5 with threaded side wall 51 is screwed on the control ring 3 to secure the plunger 4 in the control ring 3 with the flange 41 abutting the shoulder 38. An annular seal 52 is provided between the lower end of the side wall 51 and the top flange 41 of the plunger 4 to prevent leakage. On the top wall of the nozzle cup 5, a plurality of orifices 59 are formed therethrough to define the outlet passage for fluid.

OPERATION

When the spray nozzle 1 in accordance with the present invention is closed, the control ring 3 is in the lowermost position with the cups 34 in the lower end of the inclined slots 23 and 24. When the control ring 3 is so rotated that the cups 34 move along the slots 23 and 24 and the control ring 3 together with the plunger 4 is moved upward, leaving a gap between the cone 44 and the gasket 29 to define a passage for the fluid. With further rotation of the control ring 3, the gap becomes wider and the flow becomes larger. When the control ring is in the uppermost position, that is, the cups 34 are at the upper end of the inclined slots 23 and 24, the gap is widest and the flow is maximum.

Figure 3A:
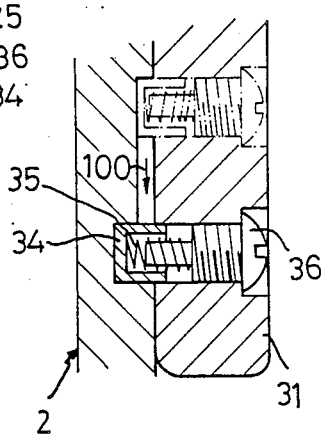
FIG. 3A shows the movement of the control ring to interrupt the flow.

To interrupt the flow, as shown in FIG. 3A, the control ring 3 can be moved from the uppermost position to the lowermost position with the cups 34 sliding downward along the vertical slots 25 and 26 as the arrow 100 shows.

In order to prevent the spray nozzle 1 from being incidentally fully opened via the vertical slots 25 and 26 the depth of both of the helically-inclined slots 23 and 24 is increasing from the uppermost end to the lowermost end and the depth of the vertical slots 25 and 26 is the same as the uppermost end of the inclined slots 23 and 24. Due to the difference in depth between the vertical slots 25 and 26 and lowermost ends of the inclined slots 23 and 24, the cups 34 cannot move upward, along the vertical slots 25 and 26, from the lowest position.

MODIFICATION

Figure 5:
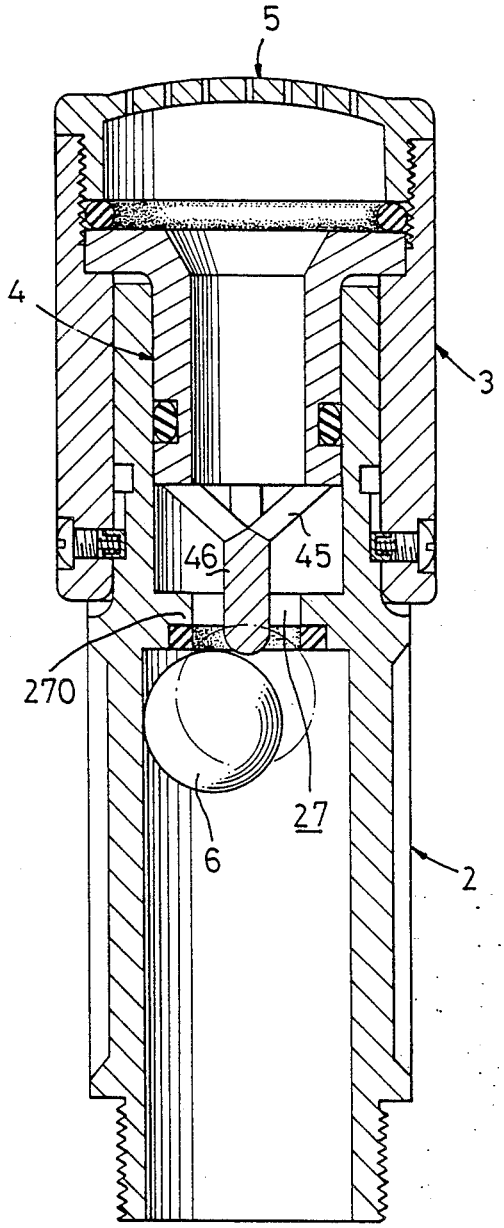
FIG. 5 is a cross-sectional view showing a further form of spray nozzle with the feature of the present invention incorporated therein.

Instead of using a cone to cut off the flow, a ball can perform the same function. As shown in FIG. 5, the cone 44 is replaced by a cylinder 46 which is smaller in diameter than the hole 27 formed in the partition plate 270. A ball 6 is so disposed inside the lower interior of the barrel 2 that when the control ring 3 is higher than a position where the lower end of the cylinder 46 is contacting the ball 6, the ball 6 is pushed toward the hole 27 by the fluid to close the hole 27 and stops the fluid. When the control ring 3 is lowered to push the ball 6 away from the hole 27, a flow established. The lower the control ring 3 is, the further away from the hole 27 the ball 6 is and the larger the flow is. Under this condition, the deepest end of the helically-inclined slots 23 and 24 are in the uppermost position and the shallowest end in the lowermost position so as to prevent the control ring 3 from directly moving downward and thus fully opening the spray nozzle 1 incidentally.

Figure 6:
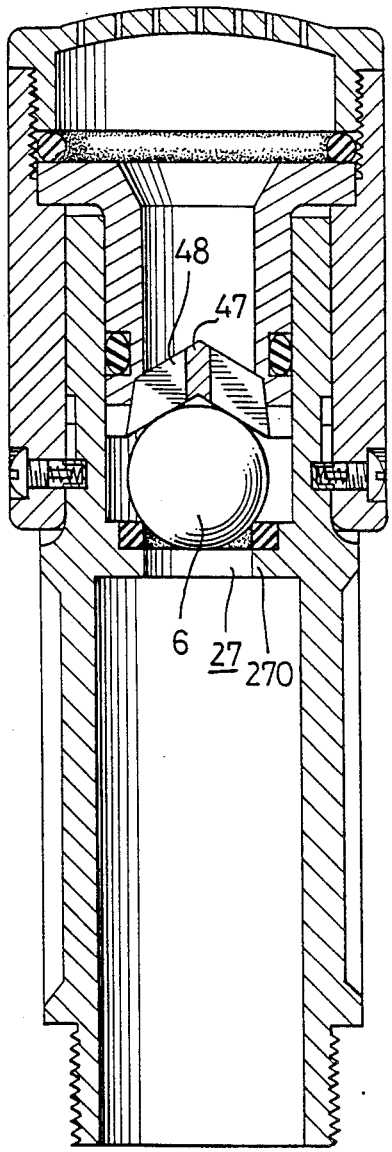
FIG. 6 is also a cross-sectional view showing a still further form of spray nozzle with the feature of the present invention incorporated therein.

Another modification is shown in FIG. 6. The ball 6 is placed between the plunger 4 and the partition 27. The cylinder 46 and connecting rods 45 in FIG. 5 are replaced by an upward conically-shaped structure which is a central rod 47 with a plurality of downward-inclining, radial septa 48 attached thereon and connecting the lower end of the plunger 4 so as to form an upward conical seat to receive the ball 6.

Figure 7:
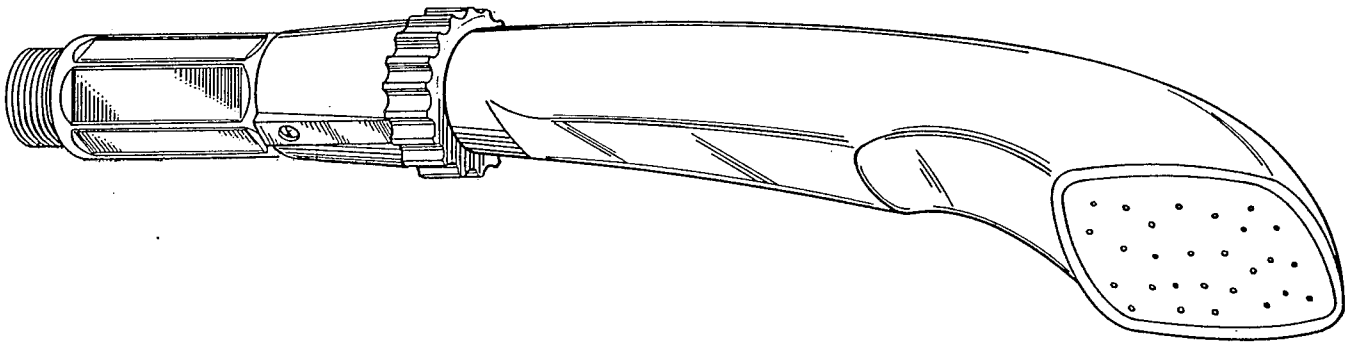
FIGS. 7, 8 and 9 show perspective views corresponding to different modification of the nozzle cup.
Figure 8:
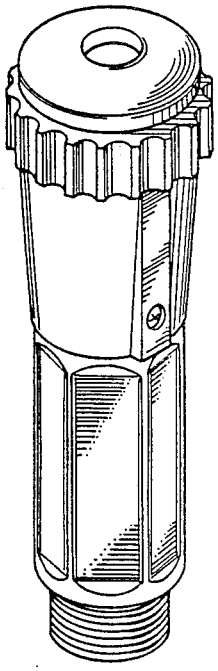
Figure 9:
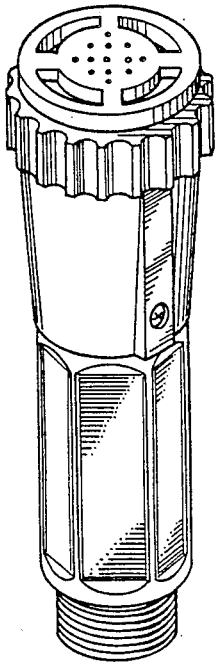

Certainly, modifications on the nozzle cup 5 are also possible FIGS. 7, 8 and 9 show different modifications of the nozzle cup 5.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the scope of the claims or that form their functional as well as conjointly cooperative equivalents are, therefore, intended to be embraced by those claims.

I claim:

1. A flow controllable spray nozzle comprising an internally-threaded control ring having an inside diameter greater than an inside diameter of a cylindrical housing integrated thereunder, a hollow plunger with a radial flange disposed around an upper end thereof and a flow control means disposed thereunder, a nozzle cup with a threaded side wall screwable into said control ring, and a barrel having a handle section formed around a lower portion thereof and a threaded lower end for attachment to a standard supply pipe or hose;

the interior of said barrel being divided by a partition plate into two sections, an upper interior section and a lower interior section, said partition plate having a central hole formed therethrough and an annular shoulder around said central hole with a gasket received therein; said internally-threaded control ring having the inside diameter greater than the inside diameter of said cylindrical housing and forming a shoulder therebetween, said plunger being secured inside said housing with said radial flange abutting said shoulder by said nozzle cup screwing on said control ring so as to define a space therebetween complemental in shape and size to an upper portion of said barrel, an annular seal further provided between said nozzle cup and said radial flange to prevent leakage, another annular seal being disposed in a circumferential groove formed on an outside surface of said plunger to prevent the leakage between said plunger and said barrel;

said control ring together with said plunger and said flow control means, having been displaced on the upper portion of said barrel, being axially movable with respect to said barrel by means of an adjusting means to adjust the flow rate;

said adjusting means comprising a pair of helically-inclined slots symmetrically disposed around the outside surface of said barrel with the first end of the first helically-inclined slot slightly overlapped by the second end of the second helically-inclined slot and the first and of the second helically-inclined slot slightly overlapped by the second end of the first helically-inclined slot, and a pair of threaded holes diametrically symmetrical formed through said housing with, in order, a cup having the diameter thereof substantially the same as the width of the helically-inclined slots, a coil spring with one end thereof disposed in said cup, and a screw with a post projecting therefrom and encompassed by the other end of said coil spring received in each of said threaded holes, said adjusting means being so disposed that when said screw is secured in said threaded holes on said housing, the reaction force of said spring pushes said cup into close engagement with and firmly against the corresponding helically-inclined slot and with the rotation of said control ring, said cups move along said helically-inclined slots so as to axially move said housing together with said plunger with respect to said barrel and thus adjust said flow control means and change the flow rate; and a pair of symmetrical vertical slots, a first vertical slot connecting the first end of said first helically-inclined slot and the second end of said second helically-inclined slot and a second vertical slot connecting the second end of said first helically-inclined slot and the first end of said second helically-inclined slot so that the plunger is vertically movable with said cups sliding along said vertical slots to interrupt the flow.

2. A flow controllable spray nozzle as set forth in claim 1 wherein the depth of each said helically-inclined slot is continuously increased from the second end thereof, which is an upper end, to the first end thereof, which is a lower end, and the depth of each said vertical slot of substantially the same as the depth of the upper end of each said helically-inclined slot so as to form a jump between each said vertical slot and the lower end of each said helically-inclined slot, preventing said plunger from moving upward along said vertical slots.

3. A flow controllable spray nozzle as set forth in claim 1 wherein the depth of each said helically-inclined slot is continuously increased from the first end thereof, which is a lower end, to the second end thereof, which is an upper end, and the depth of each said vertical slot is substantially the same as the depth of the lower end of each said helically-inclined slot so as to form a jump between each said vertical slot and the upper end of each said helically-inclined slot, preventing said plunger from moving downward along said vertical slots.

4. A flow controllable spray nozzle as set forth in claim 1 wherein said flow control means comprises a downward pointing cone connecting to a lower end of said plunger with a plurality of small rods so that when the plunger is in a lowest position, the cone is in close contact with said gasket cutting off the flow, and when the plunger moves upwards from the lowest position a gap is formed between said cone and said gasket and becomes wider thereafter and the flow increases.

5. A flow controllable spray nozzle as set forth in claim 2 wherein said flow control means comprises a downward pointing cone connecting to a lower end of said plunger with a plurality of small rods so that when the plunger is in a lowest position, the cone is in close contact with said gasket cutting off the flow, and when the plunger moves upwards from the lowest position a gap is formed between said cone and said gasket and becomes wider thereafter and the flow increases.

6. A flow controllable spray nozzle as set forth in claim 1 wherein said flow control means comprises a cylinder connecting to a lower end of said plunger with a plurality of small rods and having a diameter thereof less than that of the central hole formed in said partition plate, and a ball having a diameter larger than that of said central hole disposed inside said lower interior section of said barrel so that when said plunger is in a highest position, said cylinder does not contact said ball and said ball is positioned by the flow to cover the central hole and when said plunger moves downward, said cylinder forces said ball away from the central hole and opens said central hole.

7. A flow controllable spray nozzle as set forth in claim 3 wherein said flow control means comprises a cylinder connecting to a lower end of said plunger with a plurality of small rods and having a diameter thereof less than that of the central hole formed in said partition plate, and a ball having a diameter larger than that of said central hole disposed inside said lower interior section of said barrel so that when said plunger is in a highest position, said cylinder does not contact said ball and said ball is positioned by the flow to cover the central hole and when said plunger moves downward, said cylinder forces said ball away from the central hole and opens said central hole.

8. A flow controllable spray nozzle as set forth in claim 1 wherein said flow control means comprises an upward pointing conically-shaped structure which is a central rod with a plurality of downwardly-inclined, radial septa attached thereon and connecting to a lower end of said plunger to define an upward conical seat for a ball disposed between said plunger and said central hole formed in said partition plate so that when said plunger is in the lowest position, said ball is forced against said gasket closing said central hole and when said plunger moves upward, the flow moves said ball from said gasket opening said hole.

9. A flow controllable spray nozzle as set forth in claim 2 wherein said flow control means comprises an upward pointing conically-shaped structure which is a central rod with a plurality of downwardly-inclined, radial septa attached thereon and connecting to a lower end of said plunger to define an upward conical seat for a ball disposed between said plunger and said central hole formed in said partition plate so that when said plunger is in the lowest position, said ball is forced against said gasket closing said central hole and when said plunger moves upward, the flow moves said ball from said gasket opening and said hole.

* * * * *